United States Patent [19]

Fujimori et al.

[11] 4,110,863

[45] Sep. 5, 1978

[54] APPARATUS FOR CLEANING INNER SURFACES OF MOULDS

[75] Inventors: Shigeaki Fujimori, Hirakata; Shigekazu Hirata, Omihachiman; Akira Kitamura, Osaka, all of Japan

[73] Assignee: Osaka Fuji Kogyo, Ltd., Amagasaki, Japan

[21] Appl. No.: 797,378

[22] Filed: May 16, 1977

[30] Foreign Application Priority Data

May 19, 1976 [JP] Japan ..... 51/58433

[51] Int. Cl.[2] ..... B08B 9/08

[52] U.S. Cl. ..... 15/104.1 C; 15/56

[58] Field of Search ..... 15/56, 104.1 C; 134/8

[56] References Cited

U.S. PATENT DOCUMENTS

| | | | |
|---|---|---|---|
| 1,767,795 | 6/1930 | Huff | 15/140.1 C |
| 2,406,546 | 8/1946 | Kinney et al. | 15/104.1 C |
| 3,996,637 | 12/1976 | Shibata et al. | 15/56 |

*Primary Examiner*—Edward L. Roberts

*Attorney, Agent, or Firm*—Stevens, Davis, Miller & Mosher

[57] ABSTRACT

An apparatus for cleaning inner surfaces of moulds such as ingot moulds, which comprises a swivel ring rotatably mounted on travelling means, means for swivelling said ring, guiding means mounted on said swivel ring, and a cleaner assembly elevatably supported in said guiding means. The cleaner assembly comprises a cleaner shaft having a plurality of cleaning members such as link chains, which is adapted to be rotated and oscillated during operation. The apparatus makes it possible to clean the inner surfaces of bottle-shaped moulds with high efficiency, as well as those of normal moulds. The apparatus can be controlled remotely through television.

3 Claims, 12 Drawing Figures

APPARATUS FOR CLEANING INNER SURFACES OF MOULDS

This invention relates to an apparatus for cleaning inner surfaces of moulds.

In order to produce ingots with good casting surfaces, it is required to keep inner surfaces of ingot moulds clean by periodically removing scale adhered thereto. Up to now, the removal of the scale has been effected by the use of cleaning means comprising one or more brushes or chains which are hung by a portal crane and adapted to rub off or smash up the scale by the translation and/or rotating motion thereof. However, it is impossible with such conventional cleaning means to clean the inner surface of a bottle-shaped mould, particularly, upper and lower corners thereof because the brushes or chains cannot be moved in the horizontal direction beyond the reduced dimension of the opening at the neck portion of the mould, through which the brushes or chains are inserted into the mould. It is also impossible to control such means remotely since the opening or chains disappear behind obstacles, resulting in occurrence of dead angles. In addition, it is difficult to clean inner surfaces of moulds efficiently.

It is therefore an object of the present invention to provide an apparatus for cleaning inner surfaces of moulds which makes it possible to clean efficiently not only inner surfaces of normal moulds but also those of bottle-shaped moulds.

Another object of the present invention is to provide an apparatus for cleaning inner surfaces of moulds, which can be operated with ease by remote control.

According to the present invention, there is provided an apparatus for cleaning inner surfaces of mould, which compries a travelling deck, a transversely travelling club truck movably mounted on said deck, a longitudinally travelling truck movably mounted on said club truck, a swivel ring rotatably mounted on said longitudinally travelling truck, means for swivelling said ring, guiding means mounted on the central portion of said swivel ring, and a cleaner assembly elevatably supported in said guiding means, said cleaner assembly comprising a driving means box provided at its bottom with a downwardly extending cleaner body, a cleaner shaft having a plurality of cleaning members such as chains and being pivotally connected to the lower end of said cleaner body, means for rotating said cleaner shaft, and means for oscillating said cleaner shaft.

These and other objects and features of the invention will be further apparent from the following description taken in conjunction with the accompanying drawings which show, by way of example only, one form of an apparatus for cleaning inner surfaces of moulds embodying the invention.

Figure 1:
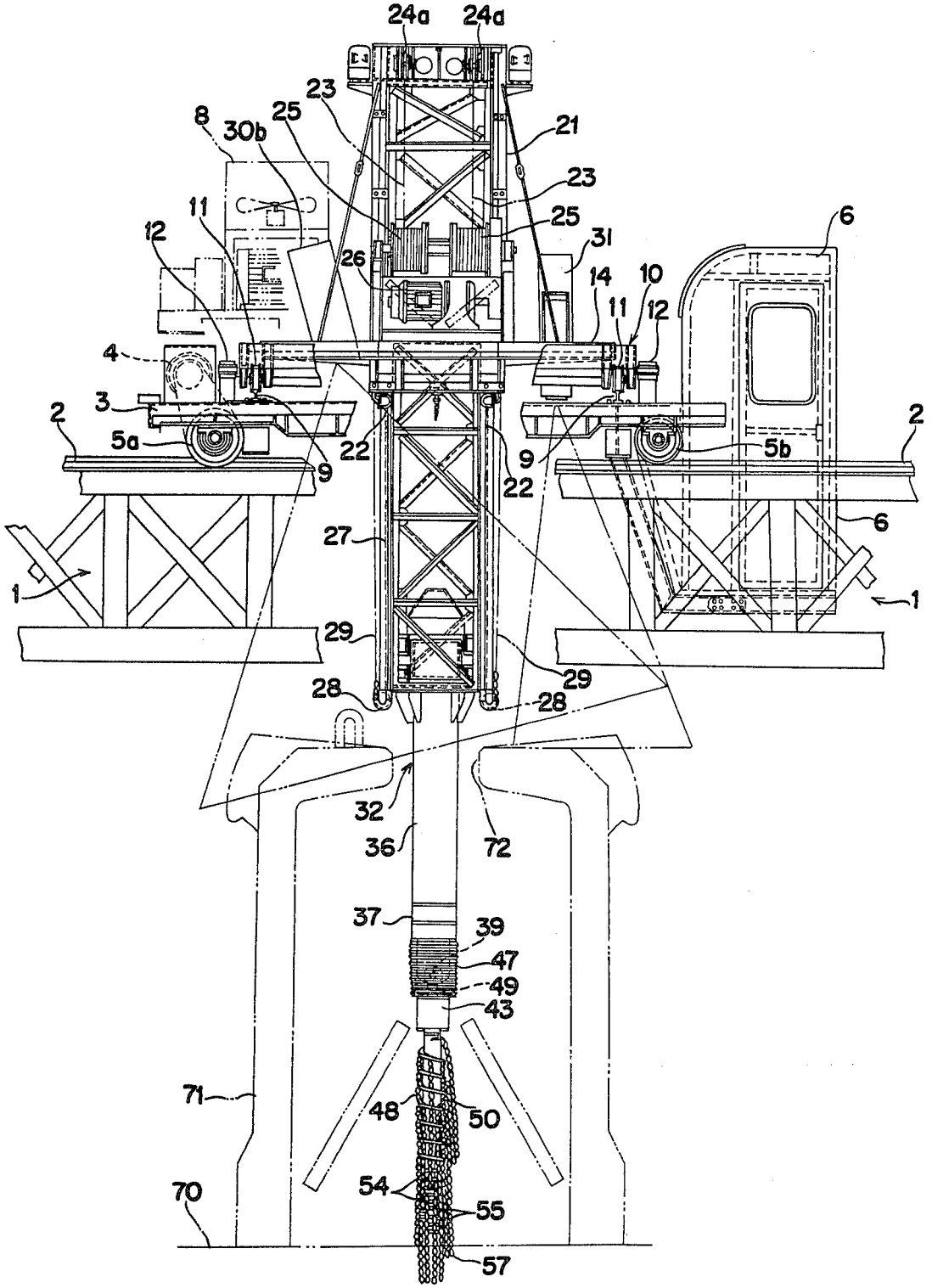
FIG. 1 is a side view of an apparatus for cleaning inner surfaces of moulds according to the invention.
Figure 4:
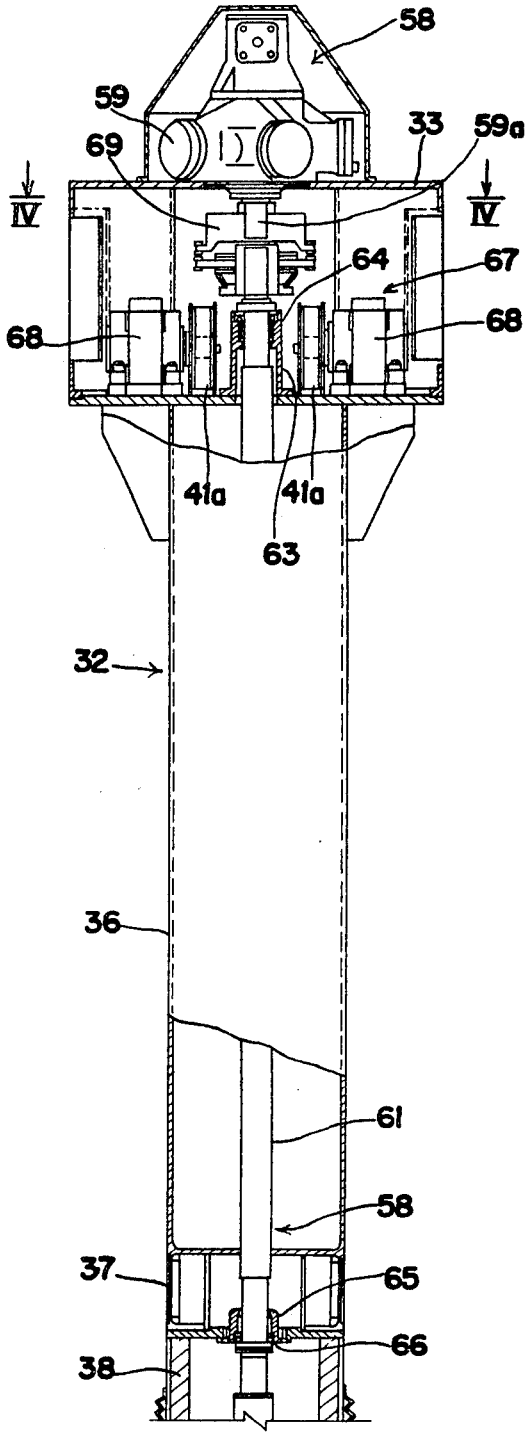
Figure 4:
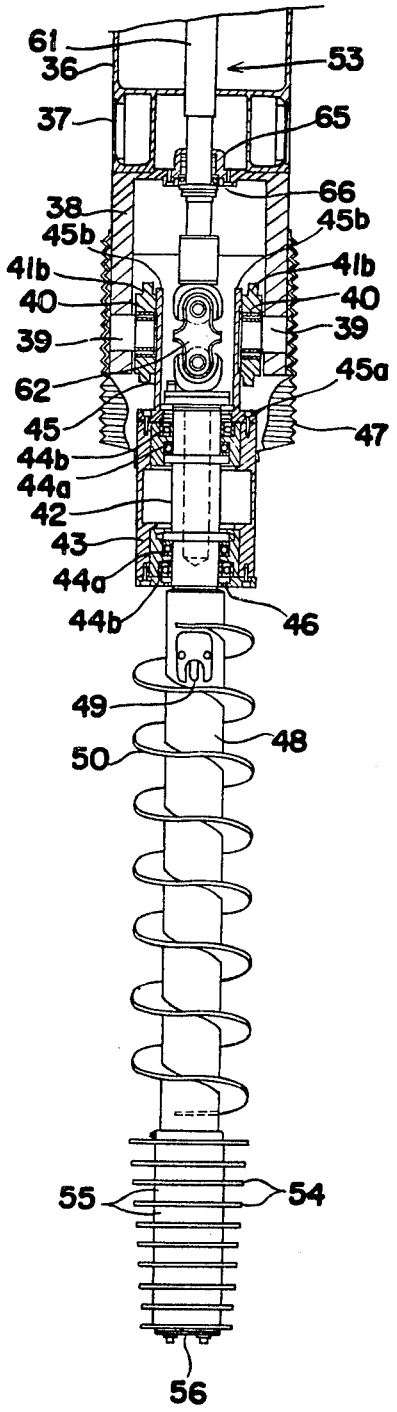
Figure 5:
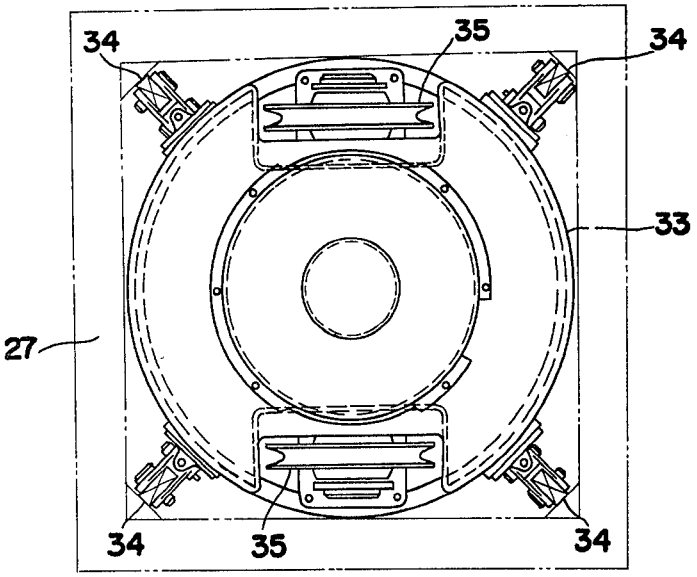

FIG. 4*a* is an enlarged section view showing an upper half of the cleaner assembly taken from FIG. 1;

FIG. 4*b* is an enlarged section view showing a lower half of the cleaner assembly taken from FIG. 1;

FIG. 5 is a plan view of the cleaner assembly taken from FIG. 4*a;*

Figure 6:
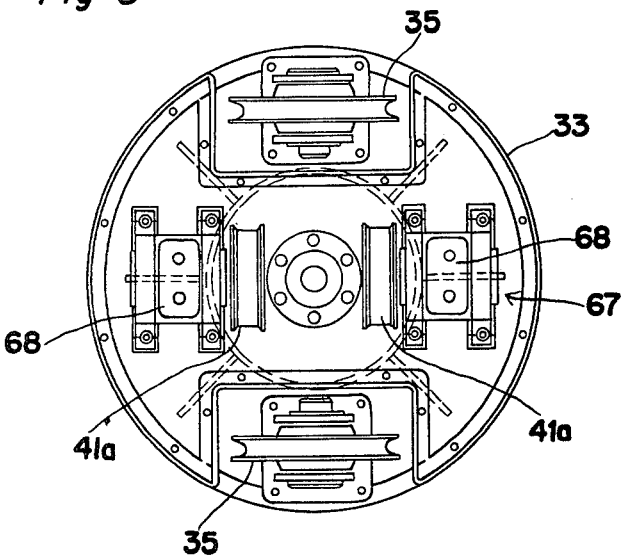

FIG. 6 is a section taken on line IV—IV in FIG. 4*a;*

Figure 7:
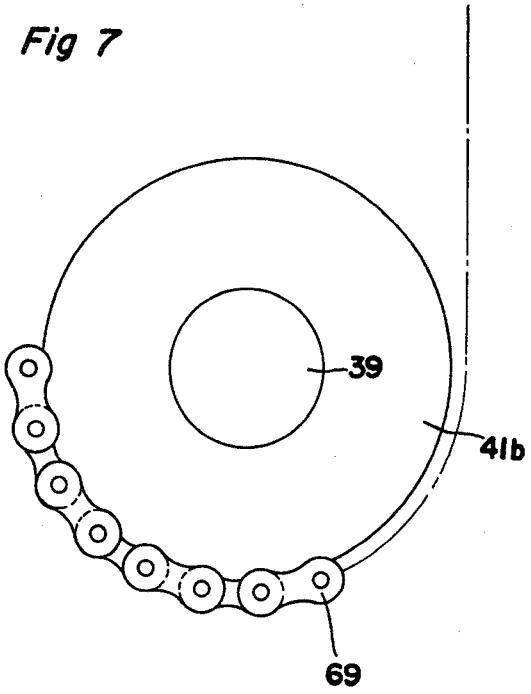

FIG. 7 is an elevational view of a sprocket taken from FIG. 4*b;*

Figure 11:
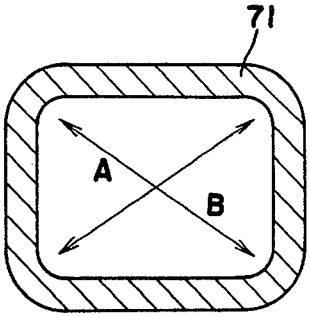
Figure 8:
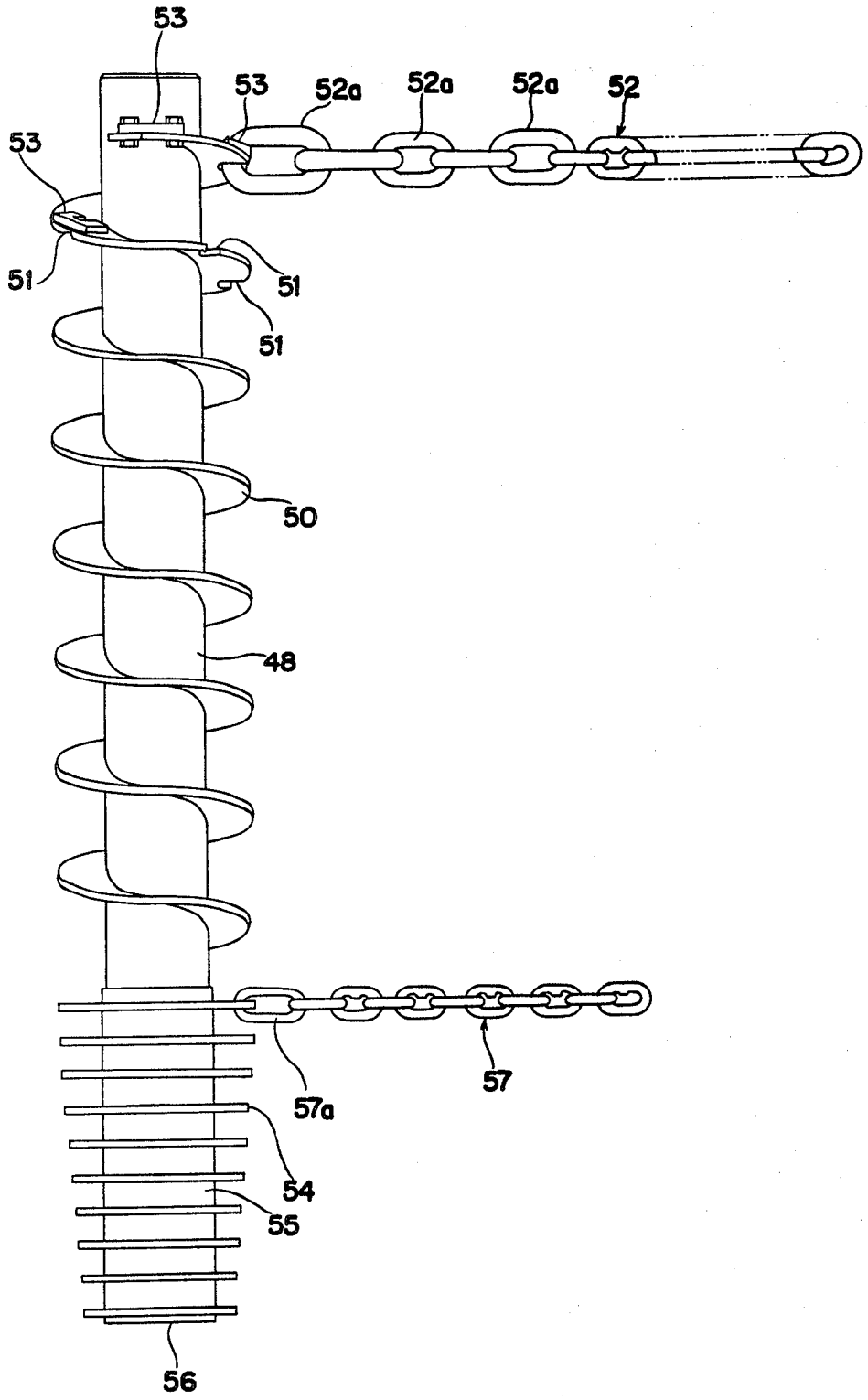
Figure 9:
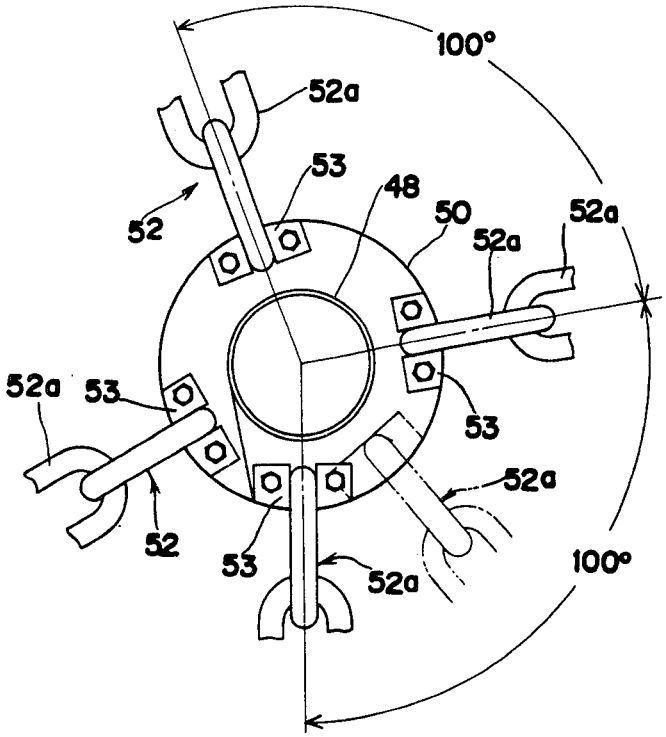
Figure 10:
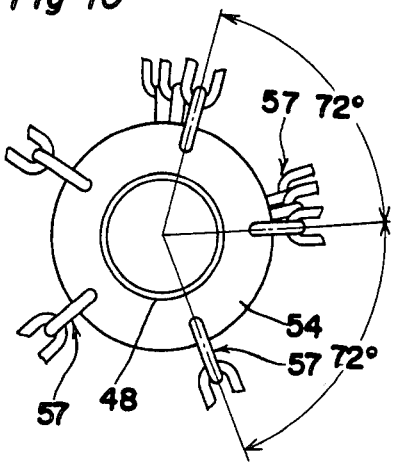

FIG. 8 is a schematic elevational view showing the details of the attached position of chains;

FIGS. 9 and 10 are schematic plan views showing the details of the attached position of chains;

FIG. 11 is a view illustating the preferred direction of movement of the cleaner shaft in operation.

Figure 2:
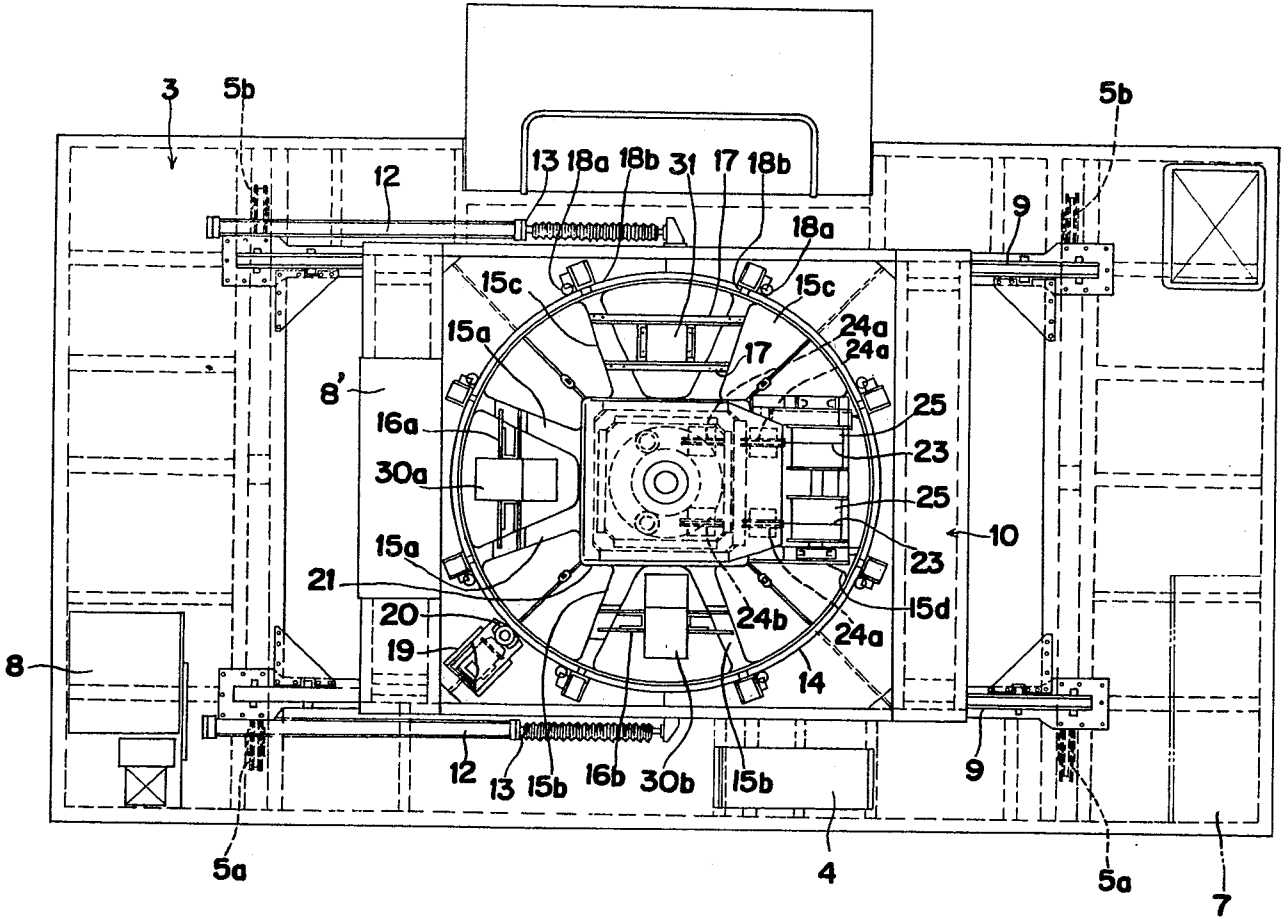
FIG. 2 is a plan view of the cleaning apparatus shown in FIG. 1.
Figure 3:
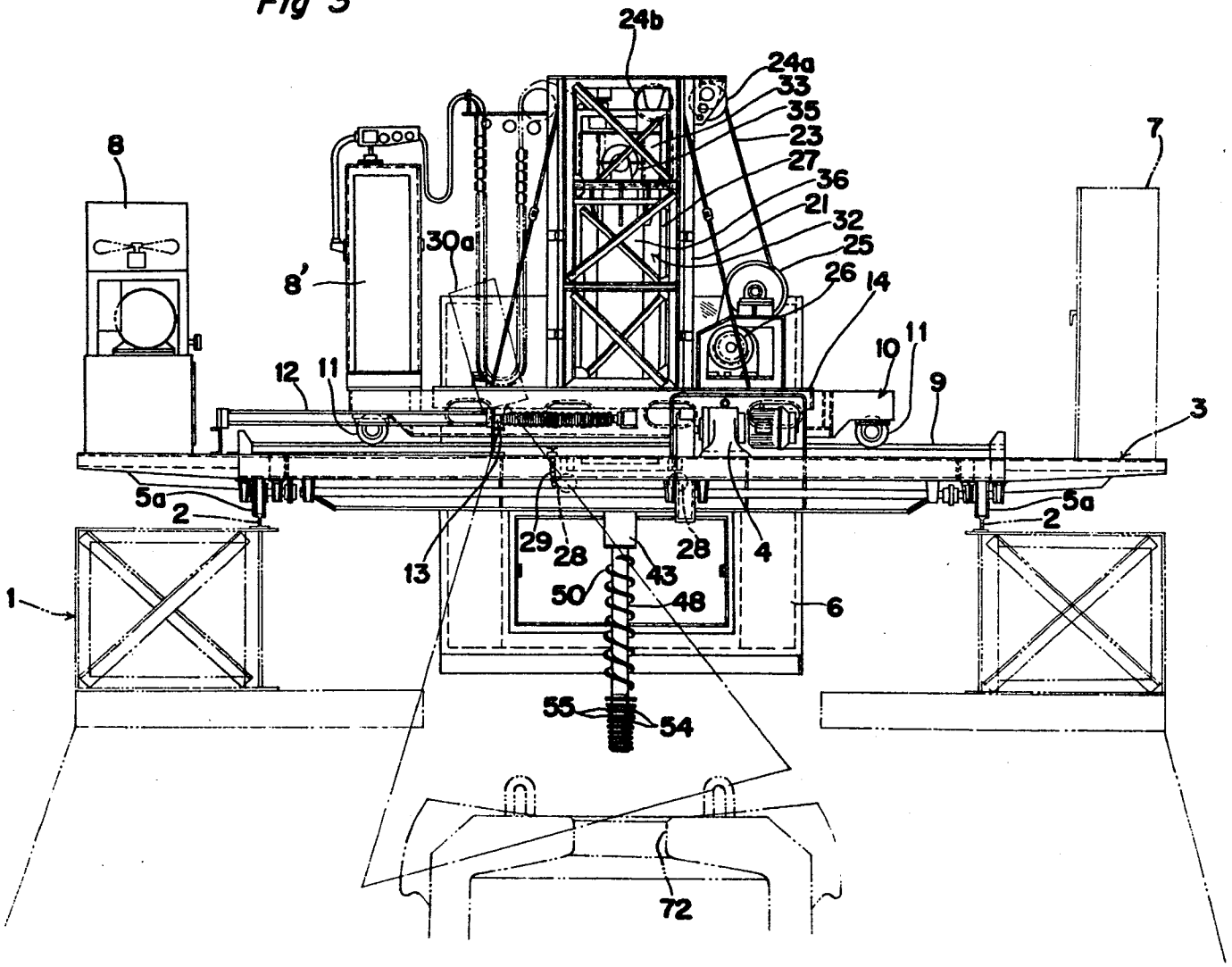
FIG. 3 is an elevational view of the cleaning apparatus shown in FIG. 1.

Referring now to the drawings, particularly FIGS. 1 to 3, an apparatus for cleaning inner surfaces of molds according to the present invention comprises a travelling deck 1 supported on the floor, a transversely travelling club truck 3 movably mounted on the deck 1, a longitudinally travelling truck 10 movably mounted on the club truck 3, a swivel ring 14 rotatably mounted on the truck 10 and provided with guiding means comprising a guide frame 21 and an elevating frame 27, and a cleaner assembly 32 which may be moved up and down in the guiding means 27.

The travelling deck 1 may run in the longitudinal direction (in FIG. 3, from left to right or vice versa) on a railroad track laid on the floor. The club truck 3 is provided with free wheels 5*b* and driving wheels 5*a* which are driven by a geared motor 4 to run the club truck 3 on a railroad track 2 laid on the deck 1 in the direction perpendicular to the travelling direction of the deck 1. The club truck 3 is provided at its one side with a operator's cab 6. Mounted on the club truck 3 are a switchboard 7 and on oil hydraulic pressure unit 8 and 8'. A spaced pair of actuating cylinders 12 are stationary mounted on the club truck 3, each end of piston rods 13 of the cylinders 12 being connected to respective sides of the truck 10.

By actuating the cylinders 12, the truck 10 with free wheels 11 may be moved on railroad track 9 laid on the club truck 3 in the same direction as the travelling direction of the deck 1. The deck 1 is moved to approximately decide the longitudinal position of the cleaning assembly 32 against the mould 71, and the club truck 3 is moved to decide the transverse position of the cleaning assembly 32. Fine adjustment of the longitudinal position of the assembly 32 may be effected by moving the truck 10.

As shown in FIG. 2, the swivel ring 14 with a flange is rotatably mounted on the central portion of the truck 10 by means of vertical rollers 18*a* and horizontal rollers 18*b*, both of which are arranged on the truck 10 around the center thereof. The vertical rollers 18*a* are rotatable around a vertical axis and in contact with the periphery of the ring 14. The horizontal rollers 18*b* include upper and lower rollers having horizontal rotation axes arranged radially, and the flange of the ring 14 is placed between upper and lower rollers 18*b*. The ring 14 is provided at its periphery with a roller chain (not shown) which is engaged with a sproket 20 adapted to be driven by an oil hydraulic motor 19 stationarily mounted on the truck 10. When the sproket 20 is driven by the motor 19, the ring 14 may swivel around its vertical rotation axis. The ring 14 is also provided at its inner side with a supporting member 15 having a square opening and four pairs of radially arranged arms 15*a*, 15*b*, 15*c* and 15*d*, on which a guide frame 21 is stationarily mounted in the vertical direction. The guide frame 21 is constructed by suitable angle members in the form of a hollow rectangular parallelipiped.

Two pairs of arms 15*a* and 15*b* adjacent each other are respectively provided with a holding member 16*a* or 16*b* on which a television camera 30*a* or 30*b* is stationarily mounted in an inclined position with respect to the upper surface of a mould 71. The cameras 30*a* and 30*b* are arranged at an angle of 90° each other. The image of the mould 71 to be televised is transferred from the television cameras 30*a* and 30*b* to receivers (not shown) arranged in the cab 6. Mounted on the holding members 17 provided to the arms 15*c* is a spotlight 31 which reflects a rod shaped mark on the upper surface of the mold 71, the mark having the same direction as the rocking direction of a cleaner shaft 42, which will be described hereinafter. Mounted on the pair of arms 15*d* is a motor 26 for driving a pair of drums 25 on which wire ropes 23 are respectively wound.

As can be best seen from FIGS. 4*a* and 4*b*, the cleaner assembly 32 generally comprises a driving means box 33, a cleaner body 36, a cleaner shaft 42, and a plurality of link chains 52 and 57. The means 58 for rotating the shaft 42 and the driving means 67 for rocking the cleaner shaft 42 are installed to the box 33. The cleaner assembly 32 is arranged in an elevating frame 27 so as to be moved up and down. The elevating frame 27 is constructed by suitable angle members in the form of a hollow rectangular parallelepiped, and is fitted inside the guide frame 21 so as to be moved up and down under the guidance of guide rollers 22 attached to the lower portion of the guide frame 21. The elevating frame 27 is provided at its lower portion with sprokets 28 with which respective roller chains 29 are engaged, as shown in FIG. 1. Each of the chains 29 is fixed at its one end to the lower part of the guide frame 21, and at its other end to the lower end of the box 33 of the cleaner assembly 32. Thus, the elevating frame 27 is supported with the chains 29 and may be moved up and down in the guide frame 21, responding to the rise and fall of the cleaner assembly as described below.

The cleaner assembly 32 is guided in the elevating frame 27 by means of guide rollers 34 provided to the periphery of the box 33 (FIG. 5). A spaced pair of sheaves 35 are rotatably mounted on the box 33. Each of the wire ropes 23 wound on the drums 25 is stretched to the upper portion of the guide frame 21 through sheaves 24*a*, 24*b* and 35, and is connected thereto via buffer spring. The sheaves 24*a* and 24*b* are provided on the upper portion of the guide flame 21, as shown in FIG. 3.

Accordingly, when the drums 25 are driven by the motor 26, the wire ropes 23 are wound on or wound off, whereby the cleaner assembly 32 is moved up and down in the elevating frame 27 which may be moved up and down in reply to the movement of the cleaner assembly 32 since the elevating frame 27 is supported with the chains 29 connected to the box 33 and guide frame 21. Thus, the cleaner assembly 32 may move in the vertical direction the distance approximately equal to the sum of the entire length of the guide frame 21 and that of the elevating frame 27.

The cleaner body 36 is of cylindrical and is fixed at its upper end to the bottom of the box 33. The cleaner body 36 is provided at its lower portion with an oscillating bearing 38 and a cover 37. As shown in FIGS. 4*b* and 7, the bearing 38 is provided with a pair of supporting bars 39 to which lower sprokets 41*b* of the roller chains 69 are rotatably attached by needle bearings 40 having roller bearings said sprokets having a horizontal rotation axis. As will be seen from From FIG. 4*b*, the cleaner shaft 42 is held at its upper portion in a bearing case 43 through thrust bearings 44*a* and radial bearings 44*b*. The bearing case 43 is fixed to a ring-shaped portion 45*a* of a supporting member 45, a pair of opposed arm portions 45*b* of the supporting member 45 being respectively attached to each side of the lower sprokets 41*b*. Thus, the cleaner shaft 42 is rotatable and oscillatable with respect to the cleaner body 36. The lower part of the bearing case 43 is provided with an oil seal 46, and the joint portion between the rocking bearing 38 and bearing case 43 is covered with a bellows 47.

The driving means 58 for rotating the cleaner shaft 42 comprises an oil hydraulic high torque motor 59 mounted on the upper end of the box 33, connecting shaft 61 coaxially arranged in the cleaner body 36 and connected at its upper end to the shaft of the motor 59 through a torque limiter coupling 60. The cleaner shaft 42 is connected at its upper end to the lower end of the connecting shaft 61 through a universal joint 62. The connecting shaft 61 is rotatably held at its upper end by a bearing 64 provided to a bearing case 63, and at its lower end by a bearing 66 provided to a bearing case 65. The driving means 67 for oscillating the cleaner shaft 42 comprises two oil hydraulic oscillating motors 68, upper sprokets 41*a* fixed to the driving shafts of the motors 68, lower sprokets 41*b* provided to the bearings 38, and a pair of roller chains 69 engaged with the sprokets 41*a* and 41*b* and attached thereto at each end.

Accordingly, when the oil hydraulic motor 59 is operated, the rotary motion thereof is transmitted to the cleaner shaft 42 through the coupling 60, connecting shaft 61 and universal joint 62, whereby the cleaner shaft 42 rotates together with cleaning members such as chains 52 and 57. Further, when oil hydraulic oscillating motors 68 are operated to rotate the upper sprokets 41*a* in a certain angle, the lower sprokets 41*b* are rotated at the same angle, and the rotary motion of the sprokets 41*b* is converted to the oscillating motion of the cleaner shaft 42 by means of the supporting member 45 fixed to the sides of the sprokets 41*b*, whereby the cleaner shaft 42 may be oscillated or swung, centering around the supporting bars 39.

A pipe 48 is coaxially arranged around the cleaner shaft 42 and is fixed thereto by a cotter 49. The pipe 48 is provided with a screw-shaped flange 50 and a plurality of disc-shaped flanges 54 having different diameters. The flanges 54 are spaced by spacers 55 one another and arranged in such a manner that the flange 54 with a smaller diameter is located below the flange 54 with larger diameter. The lower end of the shaft 42 is provide with a flange 56 to prevent the separation of the pipe 48. As shown in FIGS. 8 and 9, the periphery of the flange 50 is provided with a plurality of notched portions 51 at every angle of a 100° arc towards the lower end thereof. The chains 52 are hung respectively by U-shaped fittings 53 bolted to the flange 50. The first five links 52*a* of the chain 52 including the one engaged with the fittings 53 are of a soft material, and other links 52*a* are of a hard material. The sizes of the links 52*a* is being decreased towards the free end of the chain 52 for the purpose of making the centrifugal force acting on the last two or three links small, as compared with those acting on the other groups of links in the same chain 52.

As shown in FIGS. 8 and 10, the periphery of each flange 54 is provided with five chains 57 at an angle of 72° in such a manner that the engaged portions of the lower flange are shifted slightly in the circumferential direction from those of the upper flange. The chains 57 have a size smaller than that of the chains 52, and sizes of the links 57*a* are decreased towards the free end of the chains 57 for the purpose of making the centrifugal force acting on the last two or three links small, as compared with those acting on the other groups of the links.

In use, the travelling deck 1 is moved in the longitudinal direction, and then the club truck 3 is moved transversely to position the cleaner assembly 32 above the mould 71 mounted on the cooling base 70. The position of the cleaner assembly 32 is finally adjusted by driving the truck 10 with the oil hydraulic cylinder 12, whereby the cleaner shaft 42 is positioned just above the central part of the openeing 72 of the mould 71. The position of the mould 71 is televised by television receivers set in the cab 6 through television cameras 30*a* and 30*b*, so that the apparatus may be controlled remotely. If the mould 71 is of bottle-shaped, it is preferred to effect the cleaning of the inner surfaces thereof by oscillating the cleaner shaft 42 with chains 52 and 57 along the diagonal lines A and B of the mould, as shown in FIG. 11. In this case, if the cleaner shaft 42 is to be swung along the diagonal line A, the mark indicating the oscillating direction of the shaft 42 is reflected in the upper surface of the mould 71 by the spotlight 31, and then the swivel ring 14 is swivelled by the motor 19 to conform the mark to the diagonal line A.

Subsequently, the motor 26 is driven to arrange the cleaner assembly 32 in the operating position shown in FIG. 1, whereby the cleaner shaft with chains 52 and 57 are inserted into the mould 71. Since the chains 52 and 57 are so arranged that the adjacent chains are never lain upon another, the entire width or size of the shaft 42 and chains 52 and 57 is reduced, thus making it easy to insert the shaft 42 with the chains into the mould 71.

After that, the oil hydraulic motor 59 is operated to rotate the shaft 42 together with the chains 52 and 57, and the oil hydraulic motors 68 are operated to oscillate the shaft 42 together with the chains 52 and 57, whereby the inner surface of the mould 71 is cleaned. At the same time, the cleaner assembly 32 may be moved up and down by operating the motor 26 during the cleaning operation. After stopping the operation, the oscillating direction of the shaft 42 is conformed to the diagonal line B by swivelling the ring 14 in the same manner as described above, and then the apparatus is operated again.

During operation, the free ends of the chains 52 and 57 strike the inner surfaces of the mould 71 successively and uniformly, so that unfavorable vibration of the cleaner shaft may be reduced greatly. The chains 52 are adapted to remove the coherent materials on the inner surface of the side wall and the scale adhered to the upper surface of the mould 71. The chains 57 are adapted to clean the corners of the mould 71 effectively. Since the chains 57 have rotating radii approximately equal to the curvature at the corners of the mould 71, high cleaning efficiency can be obtained. Since the chains 52 and 57 are so designed that the centrifigal force acting on the free end of the chain is smaller than the other parts of the chain, the free end of the chain is hard to be subjected to the repulsion due to the strike. Thus, the chains 52 and 57 are trailed on the inner surface of the mould 71 in the rotating direction of the cleaner shaft 42. The links of the chains attached to the flange 50 and 54 are of a soft material, the flanges are prevented from the damage. Particularly, the flange 50 is never damaged since the chains 52 are attached by the fittings 53.

Although two television cameras 30*a* and 30*b* are employed in the above embodiment, only one television camera is sufficient to prevent the dead angle.

What is claimed is:

1. An apparatus for cleaning inner surfaces of moulds comprising a travelling deck for movement relative to moulds to be cleaned, a travelling club truck movably mounted on said deck for movement transverse to said movement of said travelling deck, a travelling truck movably mounted on said club truck for movement transverse to said movement of said club truck, a swivel ring rotatably mounted on said travelling truck for movement about a substantially vertical axis, means for swivelling said ring, guiding means mounted on said swivel ring, and an elongated cleaner assembly elevatably supported in said guiding means, said cleaner assembly comprising a driving means box having a downwardly extending cleaner body, a cleaner shaft having a plurality of cleaning members and being rotatably and oscillatably connected to the lower end of said cleaner body, means for rotating said cleaner shaft, and means for oscillating said cleaner shaft.

2. The apparatus according to claim 1 further comprising one or two television cameras mounted on said swivel ring for televising the position of the mould to be cleaned.

3. The apparatus according to claim 1 further comprising a spotlight mounted on said swivel ring for reflecting a mark on the upper surface of the mould to be cleaned.

* * * * *